United States Patent [19]

Tsuda et al.

[11] 4,260,236

[45] Apr. 7, 1981

[54] ELECTROPHOTOGRAPHIC APPARATUS

[75] Inventors: Hiroshi Tsuda, Mitaka; Kiyoshi Miyashita; Masaji Nishikawa, both of Hachioji; Akira Shimizu, Fuchu; Muneo Kasuga, Hachioji, all of Japan

[73] Assignee: Olympus Optical Co., Ltd., Tokyo, Japan

[21] Appl. No.: 30,626

[22] Filed: Apr. 16, 1979

[30] Foreign Application Priority Data

Apr. 18, 1978 [JP] Japan ..... 53-46181

[51] Int. Cl.[3] ..... G03G 15/00

[52] U.S. Cl. ..... 355/3 TR; 355/3 TE; 355/14 TR

[58] Field of Search ..... 355/3 R, 3 SH, 3 TE, 355/3 TR, 14 TR, 14 SH

[56] References Cited

U.S. PATENT DOCUMENTS

| | | | |
|---|---|---|---|
| 3,685,896 | 8/1972 | Kaupp | 355/3 TR |
| 3,827,800 | 8/1974 | Tanaka et al. | 355/3 TE |
| 3,948,586 | 4/1976 | Komori et al. | 355/3 R X |
| 3,960,446 | 6/1976 | Ogawa et al. | 355/3 R X |
| 4,114,536 | 9/1978 | Kaneko et al. | 355/3 TR X |
| 4,116,556 | 9/1978 | Tanaka et al. | 355/3 TR X |

FOREIGN PATENT DOCUMENTS

| | | | |
|---|---|---|---|
| 2152500 | 4/1973 | Fed. Rep. of Germany | 355/3 TR |

*Primary Examiner*—Fred L. Braun

*Attorney, Agent, or Firm*—Haseltine and Lake

[57] ABSTRACT

An electrophotographic apparatus which includes a rotating photosensitive drum on which an electrostatic charge latent image is formed; a developing device for developing the latent image with toners to form a toner image on the drum; a transfer roller for transferring the toner image onto a record paper and arranged movably with respect to the drum; and a record paper detector for detecting a paper jamming to produce a paper jam signal. The rotation of the drum is stopped and the transfer roller is moved away from the photosensitive drum in response to the paper jam signal so as to make it easy to remove the jammed paper, and the transfer roller is moved into an initial operative position after the drum has rotated by such an angle that residual toners and electrostatic charge on the drum pass through the transfer roller.

16 Claims, 11 Drawing Figures

19
20
58
59
56
57
45
70
77
14
46a
45a
46
80
74
75
83
86
93
87
92
91
94
91A
85
95
88
89
90
55
40
36
37
38
54
50
53
51

ELECTROPHOTOGRAPHIC APPARATUS

BACKGROUND OF THE INVENTION

This invention relates generally to an electrophotography, and more particularly, to an electrophotographic apparatus comprising a transfer member for transferring a toner or charge image onto a record paper.

Heretofore there have been developed various kinds of electrophotographic apparatuses in which plain papers are used as record papers. In such plain paper copying (PPC) machines an electrostatic charge latent image corresponding to a document image is formed on a photosensitive member, the latent image is developed with toners and the toned image is transferred onto a plain paper so as to obtain a copy after fixing the toner image.

There have been proposed various kinds of multiple copying machines in which a plurality of copies of a document are formed from the same and single electrostatic charge latent image once formed on a photosensitive body by repeatedly effecting developing and transferring steps for the same electrostatic charge latent image.

The present invention is particularly useful for such a multiple copying apparatus. In particular the present invention can be advantageously applied to a multiple copying machine in which the toned image is transferred onto a plain paper by means of a transferring roller to which is applied a suitable transferring bias voltage.

In the electrophotographic apparatus comprising the transfer roller attention should be paid to prevent toner particles disposed on the photosensitive member from being adhered or transferred to the transfer roller. That is to say it is necessary to avoid an off-set development of residual toners onto the transfer roller. To this end various measures have been developed. For instance, the transfer roller is urged against the photosensitive body only when the record paper is existent between the transfer roller and the photosensitive body. In this case it is also proposed to cut off the supply of the transferring bias to the transfer roller when the roller is separated from the photosensitive body. It is further proposed to discharge or erase the electrostatic charge on the photosensitive body as soon as the transfer roller is separated from the body. It is also known that upon the detection of nonexistence of the record paper at the transferring section a polarity of the transferring bias voltage is made reversed.

In the known copying machine comprising the transfer roller the roller is always made in contact with the photosensitive body under a given pressure as long as the record paper exists between the transfer roller and the photosensitive body. Therefore when a paper jam occurs at the transfer section, the jammed paper is retained between the transfer roller and the photosensitive body and thus it is quite difficult to remove the jammed paper without damaging or injuring the very expensive photosensitive body. That is to say since the transfer roller clamps the jammed paper between the roller and photosensitive member under a substantial pressure the jammed paper has to be pulled forcedly against the clamping force of the roller. Therefore the jammed paper rubs strongly the photosensitive body and roller and as the result the photosensitive body and roller are injured seriously.

When the transfer roller is remained in contact with the photosensitive member even after the jammed paper has been removed, the residual part of the toned image on the photosensitive member is transferred to the transfer roller upon starting again the duplicating operation. In order to avoid such inconvenience the polarity of the transfer bias voltage may be reversed after removing the jammed paper. But in this case the toner image of high density which has been transferred neither to the transfer roller nor to the record paper has to be cleaned by a cleaning device such as a rotating cleaning brush. Therefore the cleaning device is liable to be overloaded and could not sufficiently brush off the residual toners on the photosensitive body, and thus the photosensitive body still retains a substantial amount of toner particles. When the duplication is started again, a uniform charging has to be effected through the residual toners and the uniform charging level could not be obtained. Therefore decrease and fluctuation in a copy density and overdevelopment might occur and an image quality of the duplicated copy is extremely deteriorated.

The uniform charging level on the photosensitive member is the most important factor in the above mentioned multiple copying machine, because it determines an amount of charge of the latent image and then this amount determines the maximum number of times of repeatedly effected duplication, i.e. the maximum obtainable copy number. Therefore if the charging level deviates from a given value due to the residual toners on the photosensitive member, the image quality of copies gradually decreases in accordance with the successive duplications and thus an ability of making the multiple copies from the single latent image is extremely limited. The above mentioned problem may also occur in an electrophotographic apparatus comprising a transfer belt instead of the transfer roller.

In another type of the electrophotographic apparatus use is made of a transferring corona charger for applying to a rear surface of the record paper an electrostatic charge having an opposite polarity as that of the latent image. In such an apparatus a possibility of damaging the photosensitive member during the removal of the jammed paper from the transfer section will be smaller than the case of using the transfer roller. However a fine corona wire of the transfer corona charger might be cut off by the jammed paper. Further in an extreme case the corona wire and the photosensitive member might be shortcircuited by the jammed paper and thus the photosensitive member might be damaged to a great extent.

In another type of electrophotographic apparatus an electrostatic charge latent image formed on a photosensitive body or an insulating member is transferred onto a record paper and then the transferred latent image is developed with toners. There has been also proposed still another type of electrophotographic apparatus in which a primary electrostatic charge latent image is formed on a photosensitive screen and then a secondary latent image is formed on a record paper by means of a corona ion stream modulated with the primary latent image. In the former type copying machine the record paper has to be urged against the photosensitive or insulating member by means of a back plate serving as a transferring member. Therefore if a paper jam occurs at this transfer position, the photosensitive or insulating member might be damaged by the jammed paper during the removal thereof. In the later case when a jammed paper exists at the secondary image forming portion, the screen member and a back plate serving as a transferring member might be shortcircuited by means of the jammed paper and thus the screen member might be injured seriously.

SUMMARY OF THE INVENTION

The present invention has for its object to provide a novel electrophotographic apparatus which can avoid the above mentioned drawbacks by allowing a removal of a paper jammed at a transfer portion without damaging a member for retaining an electrostatic charge latent image or a toner image as well as a transferring member.

It is another object of the invention to provide an electrophotographic apparatus in which a toner image or an electrostatic image which is retained on a photosensitive member when a paper jam is detected can be completely removed or erased before a duplicating operation is started again after the jammed paper has been removed.

According to the invention an electrophotographic apparatus comprises a charge retentive member for retaining a visible toner image or an electrostatic charge latent image corresponding to an image of a document to be copied;

a transferring member arranged movably at a transfer section with respect to the charge retentive member between a first operative position and a second inoperative position, in the first operative position the transferring member being closely adjacent to or in contact with the charge retentive member so as to be able to transfer the toner or charge image onto a record paper which is supplied between the charge retentive member and the transferring member, whilst in the second inoperative position the transferring member being separated from the charge retentive member;

means for detecting a paper jam on a record paper feed path to produce a paper jam signal;

means for moving the transferring member from the first operative position to the second inoperative position in response to the paper jam signal and for holding the transferring member in the second inoperative position; and means for releasing the holding condition of the transferring member in the second inoperative position so as to return the transferring member to the first operative position after the jammed paper has been removed from the apparatus and the residual toner or charge image on the charge retentive member has passed through the transferring section.

In a preferred embodiment of the electrophotographic apparatus according to the invention the apparatus further comprises means for erasing a toner and/or charge image on the retaining member and the erasing means is made operative after the jammed paper has been removed, but before the transferring member returns to its first operative position.

DETAILED DESCRIPTION OF THE PREFERRED EMBODIMENTS

Figure 1:
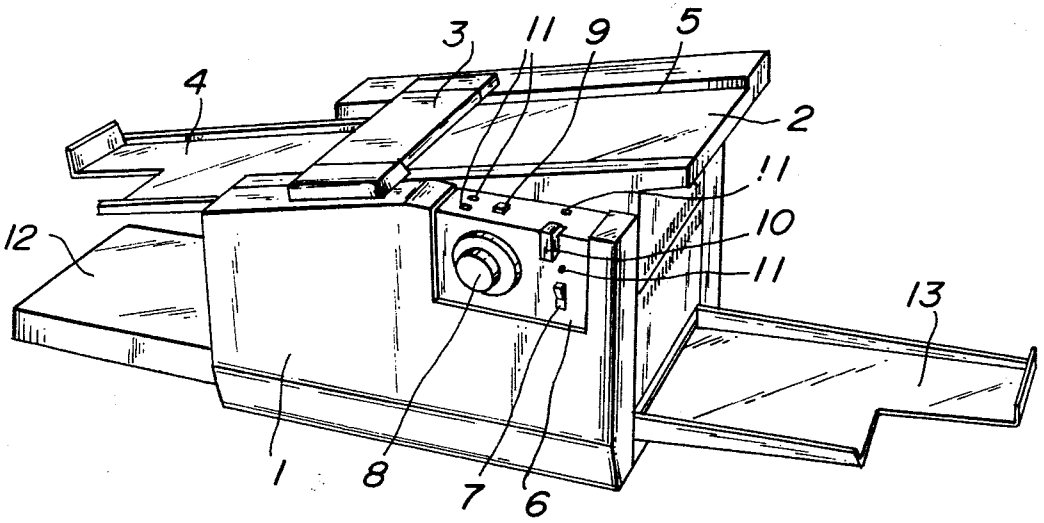
FIG. 1 is a perspective view illustrating an outer appearance of an embodiment of an electrophotographic apparatus according to the invention.

FIG. 1 shows an outer appearance of one embodiment of an eletrophotographic apparatus according to the invention. This apparatus is of a multiple copying type and can print a number of copies from the same and single electrostatic charge latent image. Referring to FIG. 1, reference numeral 1 designates a main body or outer casing which is provided along its upper surface with a document feed path composed of a document table 2, light exposure portion 3 and detachable manuscript discharge tray 4 rectilinearly arranged in the order as mentioned above. A sheet like document (not shown) is disposed on the document table 2 and slidably moved toward the left in FIG. 1. The sheet manuscript is held between feed rollers in the light exposure portion 3. The feed rollers cause the sheet manuscript to pass through the light exposure portion at a given speed and discharge it onto the document discharge tray 4. This document feed path is rectilinearly constructed as described above for the purpose of feeding the document without any trouble. In addition, in the present embodiment, the front end of the document feed path viewed in the advancing direction of the document is inclined downwardly for the purpose of effecting insertion and feed of the document in an extremely natural manner. The document table 2 is provided at its one side with an edge guide 5 extending along the advancing direction of the document and determining not only the position of the sheet manuscript to be inserted but also the position of a thick document carriage (not shown). In case of duplicating a thick document such as a book the document is placed on the thick document carriage formed by a transparent plate and having racks along both side edges and the carriage is advanced along the document table 2, while a cover provided at the portion 3 being rotated over an angle of 180°.

The main body 1 is provided at its one side with an operation panel 6 including an electric source switch, i.e. main switch 7, dial 8 for determining the number of copies to be obtained, stop or clear button 9, light amount adjusting knob 10 and various kinds of display lamps 11. The copy number setting dial 8 is rotated so as to set a desired number of copies (1 to 20 in the present embodiment) to be formed. The stop button 9 is pushed to stop the copying operation when it is started when the dial 8 is set to any erroneous number of copies. The light amount adjusting knob 10 is moved forwardly or backwardly so as to change the brightness of a fluorescent lamp (not shown) incorporated in the light exposure portion 3 and give a correct exposed light corresponding to the optical density of the manuscript. The display lamps 11 display the ON state of the electric source switch MS, absence of a record sheet in a paper cassette 12 to be described later, occurrence of jamming of the paper, and start and end of the duplicating operation. The record paper cassette 12 encloses therein record papers each having a given size and superimposed one upon the other. The cassette 12 is detachably mounted on one end surface of the main body 1. If it is desired to change the size of the record sheet, another cassette enclosing record sheets having a desired size may be selectively inserted into the main body 1. The main body 1 is provided at that end surface which is opposed to the end surface on which is mounted the cassette 12 with a copy discharge tray 13 for receiving a copy. One end of the copy discharge tray 13 is rotatably supported by the opposed side surfaces of the main body 1 and the free end of the discharge tray 13 is rotated upwardly about its supporting shaft and releasably locked to the main body 1. In this embodiment a record paper feed path extends rectilinearly from the cassette 12 to the discharge tray 13 and has a length shorter than substantially twice of length of a shortest record paper. The document feed path may be formed horizontally. Further the edge guide 5 may be provided at a front side of the document table 2.

Figure 2:
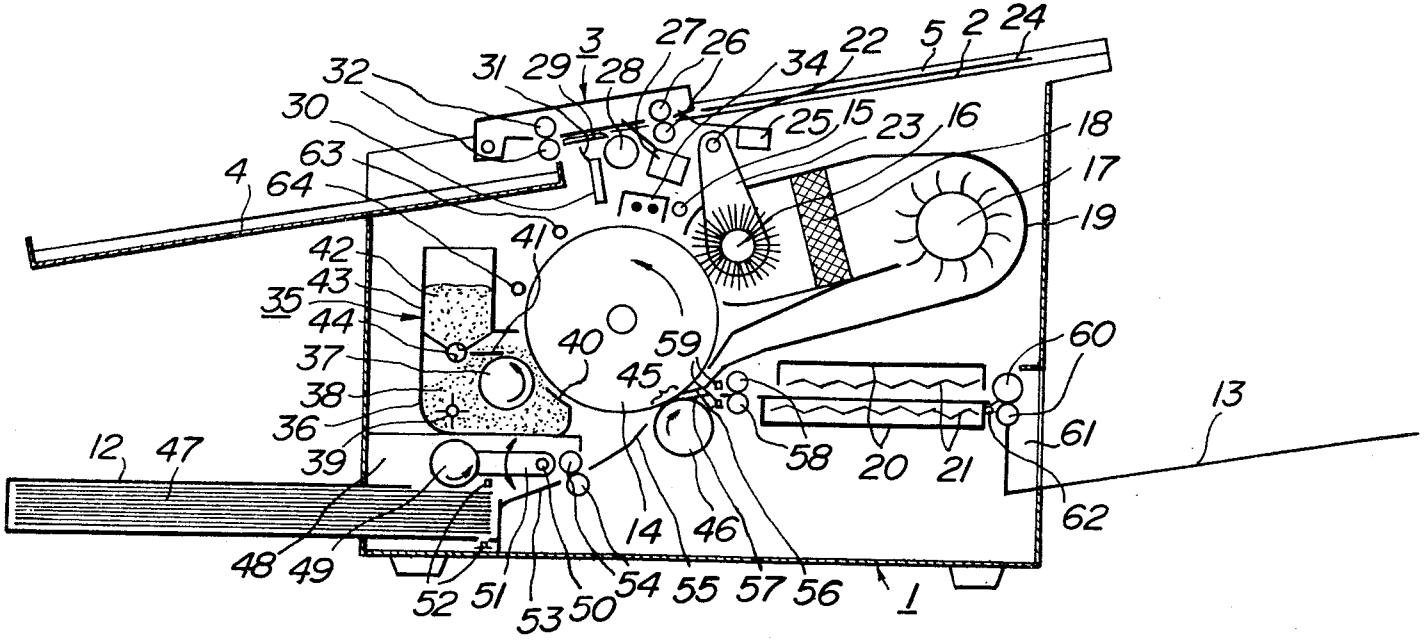
FIG. 2 is a schematic view showing an interior construction of the apparatus depicted in FIG. 1.

FIG. 2 is a schematic view illustrating an interior construction of the electrophotographic apparatus shown in FIG. 1. The apparatus comprises a photosensitive drum 14 of a seamless type which is rotatably journaled to the main body 1 in a direction shown by an arrow. When the main switch 7 is made on, the drum is rotated at a given constant speed. In this embodiment timing pulses are produced upon a rotation of the drum 14 and various operations are controlled by the timing pulses. At the same time an erasing lamp 15 arranged in proximity of the periphery of the drum 14 is made lighted on and a cleaning brush 16 is rotated, so that residual toners and electrostatic charge retained on the drum can be removed. The removed toners are attracted by a fan 17 which is rotated by a driving source such as a main motor and are collected by a filter 18. The cleaning brush 16, filter 18 and fan 17 are all arranged in a duct 19. In this embodiment this duct 19 is extended to a transferring section and an air stream caused by the rotating fan is used to peel a record paper from the drum 14. Upon the actuation of the main switch 7 a heater 21 of a fixing device 20 is energized and its temperature becomes high.

The cleaning brush 16 is rotatably supported by an arm 23 swingably journaled by a shaft 22 and is made separated from the drum 14 by means of a suitable mechanism (not shown).

After the photosensitive drum 14 has rotated over one revolution and the residual toner and charge image have been completely removed the cleaning brush 16 is separated from the drum 14 and the erasing lamp 15 is made lighted off.

Now it is assumed that a document 24 is inserted along the document table 2 from the right hand in FIG. 2 before the drum 14 has not yet rotated over one rotation after the actuation of the main switch 7. When a front end of the document 24 actuates a first document detection microswitch 25, a pair of document feed rollers 26 are rotated by means of a clutch mechanism (not shown). Then the document 24 is fed while being clamped between the rollers 26. While the document advances its front edge actuates a second document detection microswitch 27. Then the clutch mechanism is released so as to stop the rotation of the rollers 26. Thus the document is stopped at a position. As soon as the drum rotates one turn the clutch mechanism is driven again and the rollers 26 rotates again to feed the document 24. The rollers 26 are coupled with the drum 14 by means of the clutch mechanism and a suitable driving mechanism and feed the document 24 at a given constant speed in synchronism with the rotation of the photosensitive drum 14.

When the document 24 is advanced again, an illuminating fluorescent lamp 28 is lighted on so as to expose the document while it passes through a stage glass 29. Then an optical image of the exposed document is projected onto the photosensitive drum 14 by means of a projecting optical system 30 which is composed, in this embodiment, of an array of converging type optical fibers. As the illuminating lamp 28 use is made of a high brightness slit type fluorescent lamp which does not generate a large amount of heat and this lamp is arranged in a proximity of a document scanning surface of the stage glass 29. In order to illuminate the document with strong light without shading a concave mirror 31 is arranged opposite to the lamp 28. The exposed document 24 is discharged onto the tray 4 by means of a pair of feed rollers 32 which are always rotated as long as the main switch 7 is made on.

While the document 24 is fed through the stage glass 29 the drum 14 continues to rotate and is uniformly charged by a corona charger 34. The optical image of the document is projected on the charged surface of the drum 14 and thus an electrostatic charge latent image corresponding to the document is formed thereon.

The electrostatic charge image thus produced is developed with toners by a developing device 35. In this embodiment use is made of a magnet brush developing device which uses a two component developer 38 including magnetic carriers and toners. The device 35 comprises a container 36, a rotatable magnet roller 37 for forming a magnet brush, a vane 39 for mixing the carriers and toners in the developer 38, a doctor blade 40 for defining a length of the magnet brush, and a blade 41 for scraping the developer from the magnet roll 37. Above the container 36 is arranged a toner reservoir 43 containing toners 42 a given amount of which is supplied to the container 36 by means of a rotating knurled roller 44 so as to keep constant a toner density in the developer 38. In order to develop the electrostatic charge image on the photosensitive drum 14 without deteriorating the charge image it is preferable to use the carriers having high resistivity or to provide an insulating sleeve around the magnet roller 37 and either the magnet roller 37 or the insulating sleeve is rotated in such a direction that the developer moves on the drum surface in an opposite direction to the rotational direction of the drum 14. It is also preferable to provide a developing electrode in the developing device 35 and a variable developing bias voltage is applied between the electrode and the drum 14 so as to adjust a density of a developed toner image.

The developed toner image on the photosensitive drum 14 is transferred onto a record paper at a transferring section 45 in which is arranged a transfer roller 46 which is urged against the drum 14 under a suitable pressure. The construction of the transfer section including the transfer roller 46 will be explained later. The transfer roller 46 is formed by a resilient and semiconductive material such as a semiconductive rubber. Between the roller 46 and the drum 14 is applied a bias voltage having the same polarity as the charge image so as to generate an electric field for transferring the toner image onto the record paper without destroying the charge image on the drum 14.

The record paper 47 is supplied by a pick-up roller 49 from the paper cassette 12 inserted into the main body 1 through an opening 48. This feed operation of the paper is effected at a suitable timing for receiving the toner image thereon. The pick-up roller 49 is journaled to an arm 51 which is swingable about an axis 50 as shown by a double arrow so as to feed the record papers in the cassette one by one. In the main body 1 there is arranged a photoelectric sensor 52 for detecting the record papers in the cassette 12. The record paper 47 fed by the pick-up roller 49 is clamped between a pair of register rollers 54 which adjust or correct a feed timing and a feed speed. The record paper 47 is then fed through a paper guide 55 to the transferring section 45 and is clamped between the drum 14 and the transfer roller 46. The record paper having the toner image transferred thereon is peeled off the drum 14 by peeling claws 56 and the air stream supplied from the fan 17 through the duct 19. The paper is then fed by a paper guide 57 and a pair of rollers 58 into the fixing device 20. In the paper feed path between the transfer roller 46 and the feed rollers 58 is arranged a first sensor 59 for detecting a paper jam.

As stated above the heater 21 in the fixing device 20 is energized upon the actuation of the main switch 7 (see FIG. 1) and its temperature increases during the first rotation of the drum and the duplicating steps and reaches a sufficiently high value for fixing the toner image on the record paper. It should be noted that the temperature of the heater is maintained to a suitable fixing temperature by means of a suitable temperature control device (not shown). The heater 21 is formed as a zig-zag shape along the paper feed path so as to absorb a thermal expansion thereof due to a resilience of bent portions and thus it does not hang into the paper feed path.

The paper having the toner image fixed thereon is discharged on the tray 13 by means of a pair of rollers 60 through an opening 61 formed in the side wall of the main body 1. Between the fixing device 20 and the rollers 60 is arranged a second sensor 62 for detecting a paper jam. In the present embodiment the record paper feed path from the opening 48 to the opposite opening 61 is formed substantially rectilinear and its length is made shorter than twice of a length of the shortest record paper. The transfer section 45 is provided substantially at a middle of the record paper path. Therefore it is possible to remove easily a jammed paper either from the opening 48 or from the opening 61.

It should be noted that the paper feed rollers 58 and 60 are rotated as long as the main switch 7 is made on.

When it is required to form a plurality of copies of the document, the drum 14 continues to rotate and the developing, transferring and fixing steps are successively repeated for successively supplied record papers so as to obtain a number of copies up to twelve copies in this embodiment. During the multiple duplication the cleaning brush 16 is made separated from the drum 14 and the erasing and illuminating lamps 15 and 28 are made lighted off. The corona charger 34 is also maintained inoperative during the multiple duplication. The illuminating lamp 28 is lighted on during one rotation of the drum 14 after the feed of the document 24 has been initiated. Immediately after the transferring step for the last copy of the desired number of copies is started the cleaning brush 16 is made in contact with the drum 14 and the erasing lamp 15 is lighted on so as to clean the drum for preparing a next duplication. If a document is not inserted in the exposure-scanning portion 3 at this moment, the drum 14 is still rotated for a given number of turns after the last duplication has been finished and then is stopped. At the same time the fan 17 is also stopped to rotate.

On the contrary when a next document is inserted into the exposure-scanning portion 3 during the multiple duplication for the previous document and its front edge actuates the first microswitch 25, the document feed rollers 26 are rotated to feed the document. When the document actuates the second microswitch 27, the document is stopped at the stand-by position. The document is retained at this stand-by position until the duplicating operation for the previous document comes substantially to end. When the last transferring step for the last copy of the previous document initiates and a part of the drum 14 which is cleaned by the cleaning brush 16 and erasing lamp 15 comes to a position opposite to the corona charger 34, the corona charger is energized to charge uniformly the drum 14. The document retained at the stand-by position is fed in synchronism with the rotation of the drum 14 in such a manner that its front edge arrives at the stage glass 29 just when the front edge of the uniformly charged part of drum 14 comes at the projecting optical system 30. Thus an electrostatic charge latent image corresponding to the new document is formed on the drum 14. In this manner a number of copies of successive documents can be obtained without interruption and an operator can have a sufficient time for setting successive documents into the apparatus.

In FIG. 2 reference numerals 63 and 64 denotes lateral and longitudinal trimming lamps, respectively for erasing undesired charge which do not constitute the latent image so as to prevent undesired toners from being stuck to the drum. Further the copy number setting dial 8 is of a type which does not return towards a zero count even if copies are formed. The copy number set in the dial 8 is transferred into a memory at a suitable timing during the duplicating step for forming a first copy. Therefore after the copy number has been loaded in the memory, any desired copy number to be formed for a next document can be set in the dial 8, while this next document is retained at the stand-by position. Even if the copy number has been set erroneously to a value larger than a desired number and the duplication has been started, when the stop button 9 is depressed upon the duplicating step for the last copy of the desired number of copies, the duplicating operation will stop upon the formation of this last copy.

As can be understood from the above explanation it is possible to obtain a single copy each time the photosensitive drum 14 rotates one turn after the main switch 7 has been made on. Therefore in case of printing a single copy for each of successive documents a document can be set in the exposure-scanning portion 3 before the drum has rotated one turn for forming a copy of a previous document. This document is retained at the stand-by position and will be fed as soon as the one rotation of drum has been completed. In this manner the successive copies of successive documents can be printed without interruption. When the document is inserted into the apparatus after the drum 14 has rotated one revolution for the previous document, the duplication for the related document is initiated when its front edge actuates the second microswitch 27. This may be applied also to the multiple duplication in which the document is inserted into the apparatus after the multiple duplicating operation has been completed for the previous document. When the document is inserted into the apparatus after the drum 14 has rotated more than one rotation after the actuation of the main switch 7 and has completed the preparation, the drum starts to rotate upon the actuation of the first microswitch 25. During the rotation of drum the residual toners on its surface are removed by the cleaning brush 16 and the residual electrostatic charge is erased by the lamp 15. Then the drum 14 is uniformly charged by the corona charger 34 and a document image is projected thereon to form an electrostatic charge latent image. In this case the document is fed substantially in a continuous manner. If the cassette 12 is not set in the apparatus or no record paper is set in the cassette, the output signal from the first microswitch 25 is not effective and the apparatus does not initiate to work. If all record papers set in the cassette 12 are supplied during a multiple duplication for a document, a next document retained at the stand-by position in the exposure-scanning portion 3 is discharged on the tray 4 without being scanned.

Figure 3:
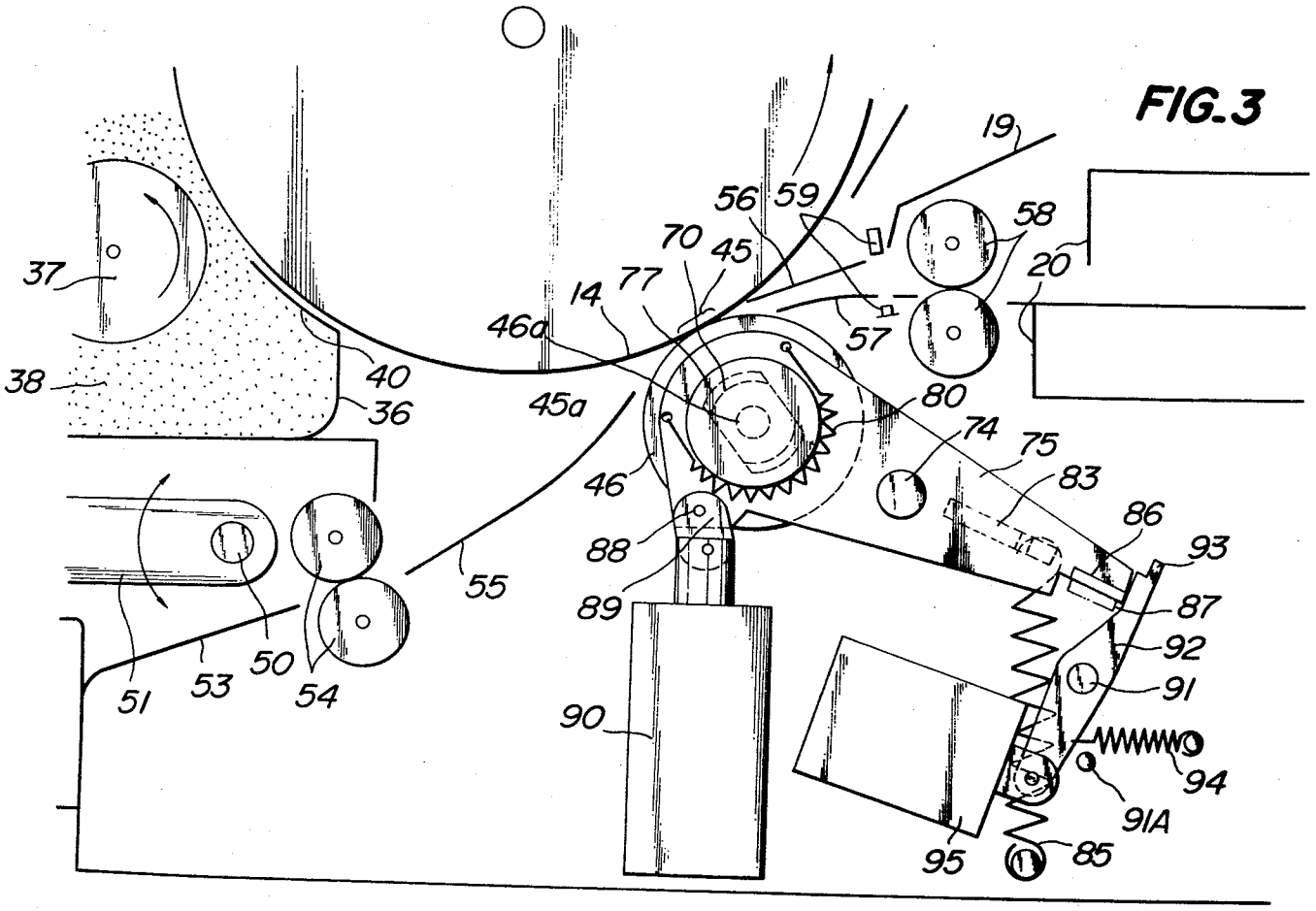
FIG. 3 is a side view illustrating a transferring section of the apparatus of FIG. 1.
Figure 4:
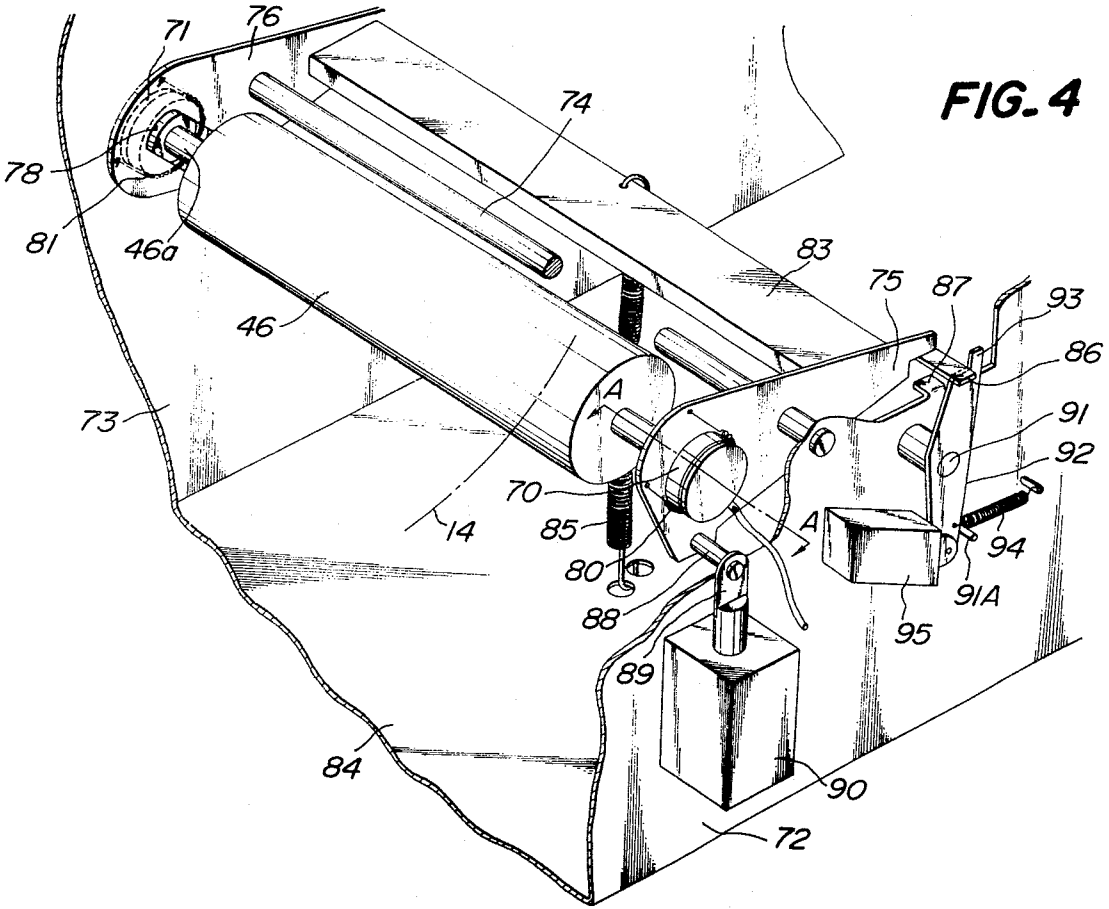
FIG. 4 is a perspective view of a transferring device of FIG. 3.

Next an embodiment of the transferring device including the transfer roller 46 will be explained in detail with reference to FIGS. 3 and 4 in which the transfer roller 46 is in contact with and is separated from the drum 14, respectively.

The transfer roller 46 is journaled at both ends of a shaft 46*a* by bearings having casings 70 and 71, respectively which are mounted on arms 75 and 76, respectively. The arms 75 and 76 are rotatably journaled to fixedly arranged members 72 and 73, respectively by means of a shaft 74. The casings 70 and 71 are made of electrically insulating material and are slidably clamped in guide recesses 77 and 78, respectively which are formed in the arms 75 and 76, respectively in a radial direction of the drum 14. In this manner the casings 70 and 71 and thus the transfer roller 46 can move in the radial direction of the drum 14. Each of the recesses has such a length in a radial direction that there is a space between the casing and an edge of the recess facing the drum while the transfer roller 46 is urged against the drum 14. To the arms 75 and 76 are secured both ends of coiled springs 80 and 81 which substantially surround the casings 70 and 71, respectively. Therefore the transfer roller 46 is resiliently urged against the drum 14 under a given uniform pressure. The end portions of the arms 75 and 76 which are remote from the roller 46 with respect to the shaft 74 are coupled to each other by means of a stay 83. Between the stay 83 and a bottom member 84 is arranged a coiled spring 85 which forces the arms 75 and 76 to rotate about the shaft 74 in a clockwise direction. The end portion of the arm 75 is provided with a projection 86 extending outwardly beyond the member 72 which is provided with a stopper 87 cooperating with said projection 86 so as to limit the rotation of the arms 75 and 76 in the clockwise direction. The arm 75 is further provided with a pin 88 which is connected through a link 89 to a solenoid 90 secured to the member 72. A pin 91 is further provided on the member 72 and a hook lever 92 is rotatably journaled to the pin 91. The hook lever 92 comprises at its one end a hook portion 93 which engages with the projection 86 of the arm 75. To the other end of the hook lever 92 is secured one end of a coiled spring 94, the other end of which is fixed to the member 72 so as to force the hook portion 93 to be urged against the projection 86. To the other end of the hook lever 92 is further secured a plunger of a return solenoid 95 which disengages the hook portion 93 from the projection against the force of the spring 94. The return solenoid 95 is secured to the wall member 72.

Figure 5:
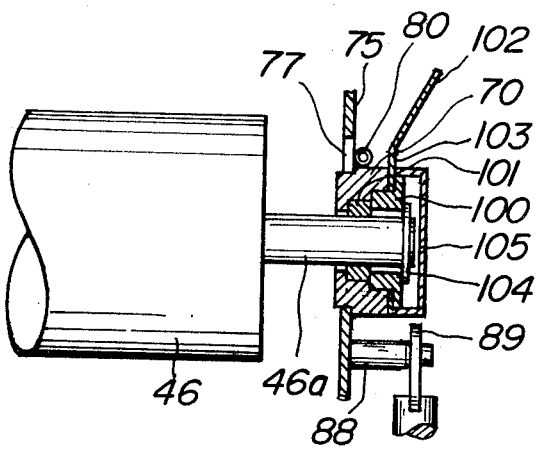
FIG. 5 is a cross-sectional view cut along a line A—A in FIG. 4.
Figure 6A:
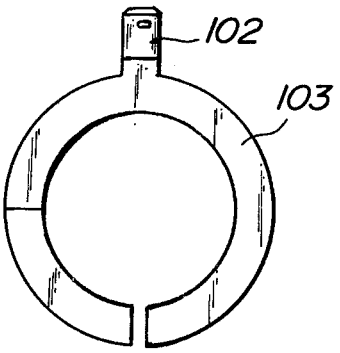
FIGS. 6A and 6B are plan view and side view, respectively showing a conductive washer serving as a terminal for applying a transfer bias to a transfer roller.
Figure 6B:
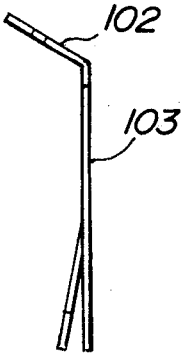

FIG. 5 is a cross-section illustrating a detailed construction of the bearing mechanism for rotatably supporting the transfer roller 46 to which a transferring bias voltage is to be applied. The shaft 46*a* of the transfer roller 46 is journaled by a bearing 101 clamped between the casing 70 and a conductive nut 100. As shown in FIGS. 6A and 6B a bias applying terminal 102 is provided integrally therewith a conductive washer 103 having a notch. The washer 103 is firmly clamped between the casing 70 and the nut 100. To the shaft 46*a* is secured a ring 104 at its top end for preventing the shaft 46*a* from falling off the casing 70. An electrically insulating cover 105 is provided so as to isolate the conductive nut 100 from the outside. In this manner the terminal 102 can be positively clamped in position and can be isolated from the arm 75 by the casing 70 made of insulating material, so that the transfer bias voltage is stably applied to the roller 46.

Now the operation of the transferring device will be explained with reference to FIGS. 2 to 4.

During the normal duplicating operation the transfer roller 46 is made in contact with the photosensitive drum 14 under a given pressure and is applied thereto a given transferring bias voltage. That is to say the arms 75 and 76 are rotated in the clockwise direction by the spring 85 and its rotation is limited by the stopper 87. Therefore the transfer roller 46 is held in the position shown in FIG. 3. At this position the transfer roller 46 is forced to move in the radial direction of the drum towards the drum by means of the springs 80 and 81 secured to the arms 75 and 76, respectively and thus the transfer roller 46 is urged against the drum 14 under the uniform pressure and is rotated together with the drum 14. Therefore the record paper supplied to the transfer section 45 is clamped between the drum 14 and the roller 46 under a uniform pressure and the toner image on the drum is effectively transferred onto the paper. In this manner the transferring step is carried out positively and correctly and the copy having the toned image of high quality can be obtained.

If a paper is accidentally jammed at the transferring section, the first paper detection switch 59 operates to produce a paper jam signal. In response to this paper jam signal the solenoid 90 is energized to pull the transfer roller 46 downwards against the spring 85. Then the roller 46 is separated from the drum surface. At the same time a reset mechanism which will be explained later is actuated. Then the projection 86 of the arm 75 moves upwards and the hook lever 92 rotates in the anti-clockwise direction. This rotation of the lever 92 is limited by a stopper pin 91A and the projection 96 engages with the hook portion 93 of the lever 91. Therefore the transfer roller 46 is mechanically held in the separated position. The casings 70 and 71 are forced to move towards the drum 14 by the springs 80 and 81, but this movement is limited by the edges of the recesses 77 and 78 formed in the arms 75 and 76, respectively. The amount of rotation of the arms 75 and 76, i.e. a stroke of the link 89 of the solenoid 90, is so determined that the transfer roller 46 is still apart from the drum surface by a given distance.

When the first paper jam detector 59 produces the paper jam signal, the display lamp 11 on the panel 6 is lighted on and the reset mechanism is actuated. Then the power supply to the driving mechanism is switched off so as to stop the duplicating operation. Such an operation is also effected when the second paper jam detector 62 produces the paper jam signal.

Next an embodiment of the reset mechanism which is actuated upon the paper jam signal will be explained with reference to FIG. 7. An alarm solenoid 110 which is energized upon the paper jam signal has a plunger 111 which is connected to one end of a lever 113 rotatably supported by a shaft 112. At the other end of the lever 113 is formed a protrusion 113*a* which engages with an alarm hook portion 115*a* provided at one end of an alarm hook lever 115 which is pivotally supported by a pin 114. To the other end of the hook lever 115 is connected a reset button 117 which projects externally beyond a fixedly arranged member 116. Between the levers 113 and 115 and the fixed member 116 are arranged coiled springs 118 and 119, respectively and thus the protrusion 113*a* engages with the hook portion 115*a*. In this condition a chip 113*b* secured to the lever 113 pushes an actuator of an alarm switch 120 so as to break its contacts.

Figure 7:
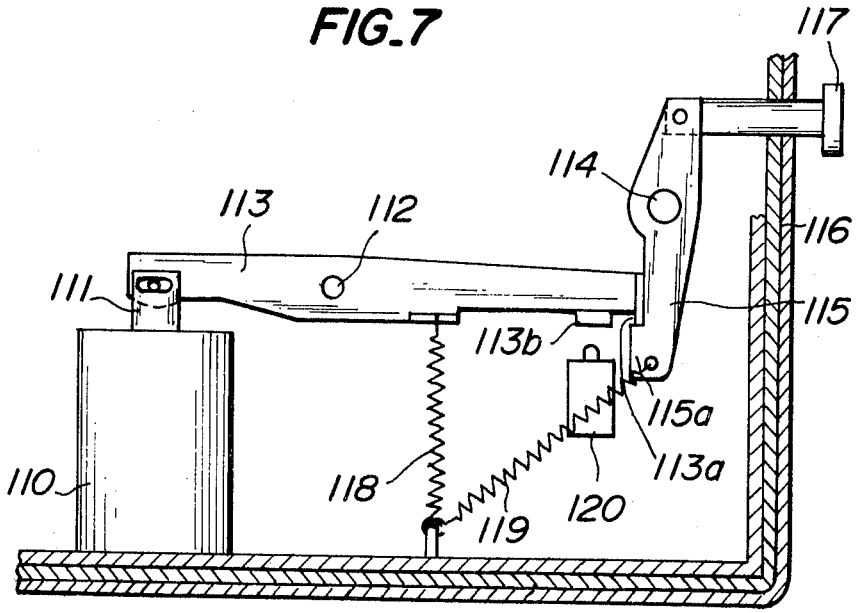
FIG. 7 is a side view illustrating a reset mechanism of the transferring device.

In the situation shown in FIG. 7 the reset mechanism has been actuated by the paper jam signal. When the alarm solenoid 110 is energized by the paper jam signal, the lever 113 rotates in the anti-clockwise direction against the spring 118 and thus the alarm switch 120 is made on. Then the lever 115 rotates slightly in the clockwise direction and the hook portion 115*a* engages with the protrusion 113*a*, so that the lever 113 is locked in the position shown in FIG. 7 by the springs 118 and 119. When the alarm switch 120 is made on, the power supply to the driving mechanism is interrupted.

In order to release the locking condition the reset button 117 is pushed to rotate the hook lever 115 against the spring 119. Then the engagement of the hook portion 115*a* with the projection 113*a* is released and thus the lever 113 is rotated by the spring 118 in the clockwise direction so as to make the alarm switch 120 off. Such a release operation should be effected after the jammed paper has been removed from the apparatus.

According to the invention when the paper jam is detected, the transfer roller 46 is separated from the photosensitive drum 14 and the reset mechanism shown in FIG. 7 is actuated so as to hold the transfer roller in the refrained position and to stop the rotation of the drum. Therefore the jammed paper can be removed from the transfer section 45 without damaging the photosensitive drum 14 and the transfer roller 46. Further in the present embodiment since the record paper feed path is made rectilinear, its length is shorter than twice that of the paper length and the transfer section 45 is provided substantially at a middle of the record paper feed path, the jammed paper can be easily removed through the opening 48 or 61 provided in the main body 1 with or without removing the paper cassette 12 or the tray 13. When the power supply to the driving mechanism is cut off, the register rollers 54, feed rollers 58 and discharging rollers 60 are made rotatable in the both directions. In this manner the jammed paper can be removed in a simple and positive manner. For the sake of security even if the main switch 7 is made off during the removal of jammed paper, the transfer roller 46 is locked mechanically in the refrained position.

Now an operation for starting again the duplication operation after the removal of the jammed paper will be explained with reference to FIGS. 2, 3, 4 and 7. For the sake of simplicity it is assumed that the power switch 7 is made off during the removal of the jammed paper. After the jammed paper has been taken off the reset mechanism is released to make the alarm switch 120 off and then the power switch 7 is made on. Then the photosensitive drum 14 begins to rotate and its surface is cleaned by the cleaning brush 16 and the erasing lamp 15. However the transfer roller 46 is not made in contact with the drum. The return solenoid 95 is energized after the drum 14 has rotated substantially one revolution and then the hook lever 92 rotates in the clockwise direction against the spring 94 so as to disengage the projection 86 of the arm 75 from the hook portion 93. Then the arms 75 and 76 rotate in the clockwise direction due to the spring 85 so as to bring the transfer roller 46 into contact with the drum 14. During this operation the casings 70 and 71 slide in the recesses 77 and 78, respectively against the coiled springs 80 and 81. Therefore the transfer roller 46 is urged against the drum surface under the given uniform pressure.

In the present embodiment use is made of the photosensitive drum 14 of seamless type and the various portions of the apparatus are controlled by the timing pulses synchronized with the rotation of the drum 14. Therefore even if the drum is stopped at any position upon the paper jamming during the duplication, the drum 14 rotates one turn from the related position before a new duplicating operation initiates after the jammed paper has been removed. Thus the residual toners and electrostatic charge on the drum are completely removed before a new electrostatic charge image is formed.

Figure 8:
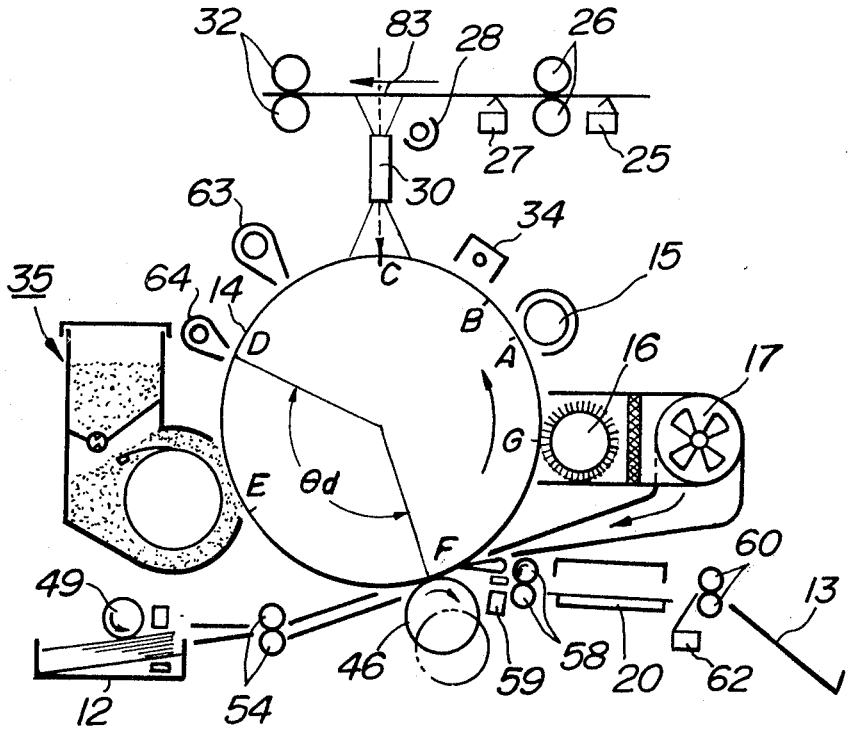
FIG. 8 is a schematic view for explaining an operation of the transferring device according to the invention.

FIG. 8 is a schematic view illustrating how to clean the photosensitive drum 14 upon the occurrence of the paper jamming. As explained above when the paper jamming is detected by the first sensor 59, the transfer roller 46 is separated from the drum 14. At the same time the reset mechanism is actuated so as to interrupt the power supply to the driving circuit. Then the drum 14 is stopped instantaneously and this stopped position is shown in FIG. 8. Under such a condition on a part of the drum 10 defined by an arc $\widehat{BC}$ a uniform positive charge is applied, on a part defined by an arc $\widehat{CE}$ an electrostatic charge image is formed, and on a part defined by an arc $\widehat{EF}$ a toner image is formed. After the jammed paper has been removed from the apparatus a new duplicating operation is started by releasing the reset mechanism and making the power switch on. Then the drum 14 begins to rotate and residual toners and charge are removed by the cleaning brush 16 and the erasing lamp 15. The transfer roller 46 is kept in the separated position until a point E on the drum 14 comes to a transferring position F, i.e. until the drum rotates over an angle of about 300°. In this manner the transfer roller can be free from toners and further the new duplicating operation can be initiated before the drum rotates one turn.

Further the transfer roller 46 can be returned at an earlier timing by utilizing the trimming lamp which is controlled by the timing pulses. If the longitudinal trimming lamp 64 is lighted on upon the actuation of the main switch, any charge on the drum after a point D on the drum is not developed. Therefore the transfer roller 46 can be returned when the point D comes to the position F. Since an angle $\theta d$ from the trimming lamp position D to the transfer position F is fixedly determined it is possible to return the transfer roller at a correct timing by counting the number of the clock pulses corresponding to said angle $\theta$d.

According to the invention it is also possible to set a new document in the apparatus after the jammed paper has been removed, but before the drum has rotated one turn. In this case the exposure-scanning for the document may be initiated before the drum 14 has rotated one turn. To this end a rear edge of the toner image or the charge latent image on the drum 14 is always detected by counting the clock pulses and the position of the rear edge upon the paper jamming is stored. After the jammed paper has been removed the transfer roller 46 may be returned when the drum has just rotated over a given angle on the basis of the stored position.

According to the invention the transfer roller 46 is hardly damaged or injured by the jammed paper during the removal of the paper it is possible to prevent effectively a local variation of the transferring bias voltage. Therefore the electrophotographic apparatus according to the invention is preferably used for the multiple duplication. Further since the transfer roller 46 is held separated from the drum upon the occurrence of the paper jamming, the photosensitive drum 14 is hardly damaged even if the transferring bias voltage is remained to be applied to the transfer roller 46.

The above mentioned operation of the transferring device is also effected when the second detector 62 detects the paper jamming. In this case if the display lamp 11 selectively indicates the paper jamming at the first and second detectors 59 and 62, the user can understand from which opening 48 or 61 the jammed paper can be easily removed.

Further since the transfer roller 46 is not fixedly journaled to movable arms, but is journaled by means of the bearing cases 70 and 71 to the arms 75 and 76 independently and thus cases can slide in the recesses 77 and 78, even if the construction including the arms 75, 76, etc is twisted, the roller is uniformly urged against the drum under a given pressure. Therefore it is possible to attain the stable transferring pressure and bias voltage so as to form a copy of very high quality. Particularly in case of multiple copying the residual toner image on the drum after the transferring step becomes uniform and thus a number of excellent copies can be obtained from the same and single charge image.

Figure 9:
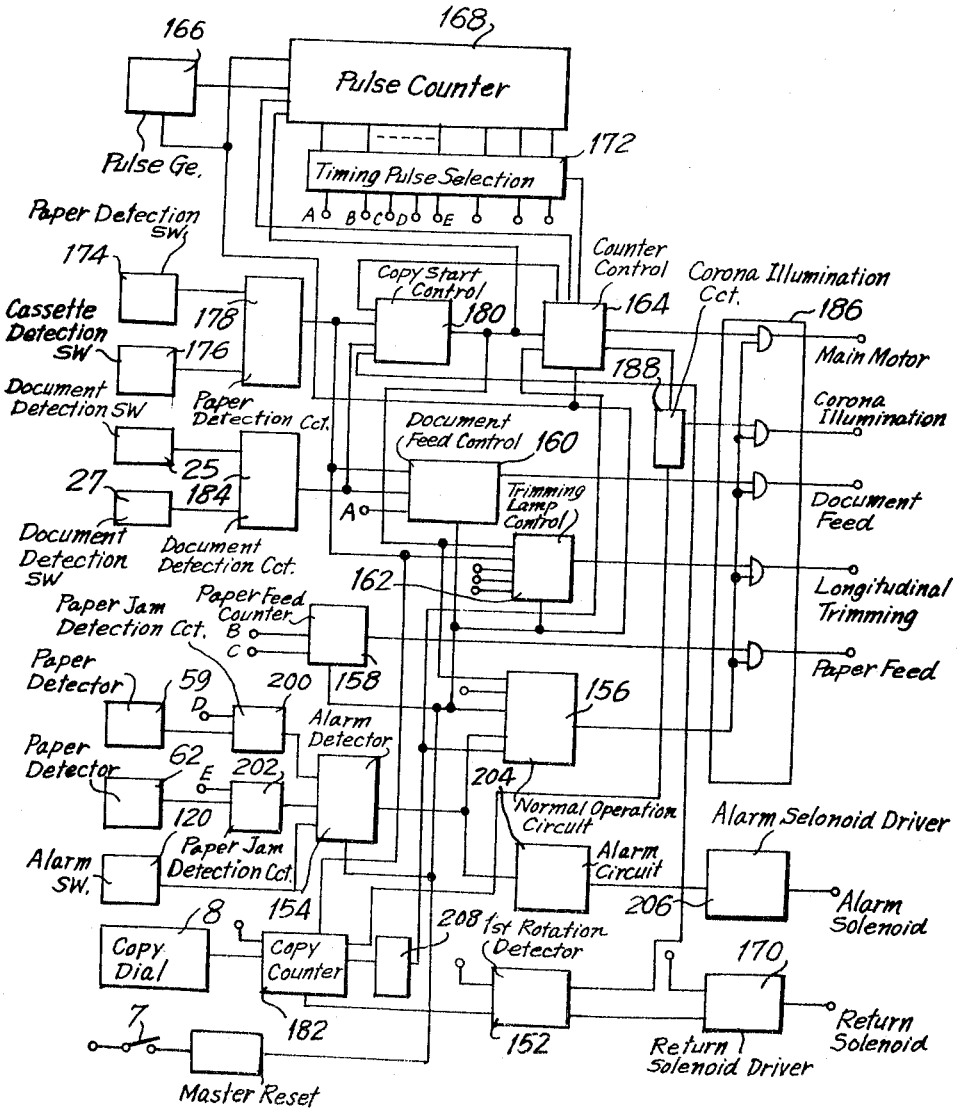
FIG. 9 is a block diagram showing an embodiment of a control circuit for controlling the operation of the apparatus according to the invention.

Now an example of a controlling device for use in the electrophotographic apparatus according to the invention will be explained with reference to FIG. 9. When the power switch 7 is closed, a master reset circuit 150 is made operative so as to reset first revolution detecting circuit 152, an alarm detecting circuit 154, a normal operation circuit 156, a paper feed control circuit 158, a document feed control circuit 160, a longitudinal trimming lamp control circuit 162, a pulse counter control circuit 164, a pulse generator 166 and a pulse counter 168. A return solenoid driving circuit 170 recieves a given signal from the first rotation detecting circuit 152 before the drum 14 has rotated one turn and energizes the return solenoid 95. When the power switch 7 is made on, the return solenoid 95 is once energized near the end of the first rotation of the drum 14. Therefore the transfer roller 46 which has been refrained from the photosensitive drum 14 is returned near the end of the first rotation of the drum after the actuation of the main switch 7.

After the main switch 7 is closed and the master reset circuit 150 is made operative, a main motor (not shown) is rotated by means of the normal operation circuit 156 so as to rotate the drum 14. At the same time the pulse generator 166 which is driven in synchronism with the drum 14 begins to generate clock pulses. The pulse generator 166 is so constructed that each time the drum rotates by 1 mm measured along its periphery one pulse is produced and an integer number of pulses such as 400 pulses are produced by one rotation of the drum 14. The pulse generator 166 may be composed of a rotating disc having formed along its periphery a number of holes or notches and of a photocoupler including a light source such as a lamp, a light emitting diode, etc. and a light receiving element such as a phototransistor, a photoelectric cell, as CdS cell, etc. disposed on respective side of the disc. Instead of the photoelectric converter use may be made of a disc having provided magnets therein and a Hall element or a disc having formed thereon a black and white pattern and a reflection type photodetector for reading the pattern.

The clock pulses thus generated are supplied to the pulse counter 168 which may be composed of a binary counter, BCD counter or shift registers. The pulse counter produces a number of trimming pulses which are supplied to a timing pulse selecting circuit 172. Now it is assumed that the pulse generator 166 generates 400 pulses per rotation of the drum 14.

The timing pulses from the selection circuit 172 are gated by an output from the counter control circuit 164 and thus when the output from the circuit 164 is produced, the timing pulses A, B, C ... can appear at outputs of the selection circuit 172.

The signal supplied to the return solenoid driving circuit 170 near the end of the first rotation of drum 14 is generated when the counter 168 counts a 383rd clock pulse after the main switch is closed. In this case the counter control circuit 164 does not produce the output signal, but the timing pulse corresponding to the 383rd clock pulse is forcedly supplied to the return solenoid driving circuit 170.

A paper detector 174 is provided to detect the record papers 47 set in the cassette 12 and comprises the photocoupler 52 including a light source and a photoelectric converter. A cassette detector 176 is to detect whether or not the cassette is correctly set in the apparatus. This detector 176 also detects the paper size. For instance, the apparatus can use three kinds of record papers, i.e. 13.97×21.59 cm (5.5×8.5 inches), 21.59×27.94 cm (8.5×11 inches) and 21.59×33.56 cm (8.5×14 inches) the detector 176 comprises two switches which are selectively actuated by three kinds of cassettes. That is to say the first switch is solely actuated by the first kind of cassette, the second switch is solely actuated by the second size of cassette, and both switches are driven by the third kind of cassette.

Figure 10:
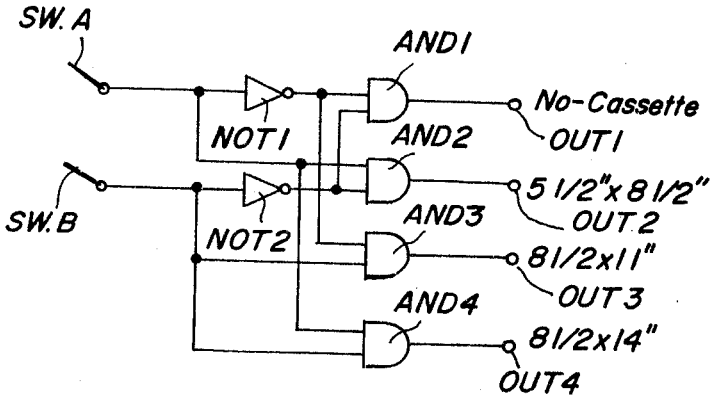
FIG. 10 is a circuit diagram illustrating a paper size detecting circuit.

As shown in FIG. 10, these switches SW·A and SW·B are connected to four AND gates AND1–AND4 through two inverters NOT1 and NOT2. Then at output terminals OUT1–OUT4 of the AND gates four kinds of signals appear. For instance, nocassette signal will appear at the output OUT1 when both switches are not actuated. In order to actuate selectively the switches SW·A and SW·B, the cassette may be provided with a recess or notch on its side wall at a position corresponding to the switch.

When the cassette is correctly set into the apparatus and the record papers are included in the cassette, a paper detection circuit 178 produces an output signal which is supplied to a copy start control circuit 180, the document feed control circuit 160, the trimming lamp control circuit 162 and a copy number detecting circuit 182.

When the first microswitch 25 is actuated by the front edge of the document, or when the second microswitch 27 detects the document, a document detection circuit 184 and the document feed control circuit 160 are made operative. An output signal from the document detection circuit 184 is supplied to the copy start control signal 180.

When the document is detected by the first microswitch 25, the output signal from the document feed control signal is supplied through an output gate circuit 186 which is enabled by the output of the normal operation circuit 156 to a document feed circuit so as to rotate the document feed rollers 26. If the document is set into the apparatus after the preparatory operation has been finished and the drum has stopped, the normal operation circuit 156 is made operative upon the actuation of the first microswitch 25 so as to energize the main motor to rotate the drum and document feed rollers 26. Therefore in this case the first microswitch 25 serves as a print start switch.

When the second microswitch 27 is made on by the advanced document, the rollers 26 are once stopped and the document is stopped at this stand-by position. Upon the actuation of the second microswitch 27 the copy start control circuit 180 is made operative to produce a copy start signal in response to which the counter control circuit 164 is actuated and the counter 168 is reset. Then the counter 168 begins to count the clock pulses.

A corona-illumination circuit 188 is operated by the copy start signal from the copy start control circuit 164 and thus the corona charger 34 and illuminating lamp 28 are made operative. When the counter 168 has counted a given number of pulses, for instance 14 pulses, the document feed rollers 26 are driven again by means of the document feed control circuit 160.

As soon as the copy start control circuit 180 is made operative the longitudinal trimming lamp control circuit 162 is driven so as to light the trimming lamp 64 on. The lamp 64 will be lighted off when the front edge of the latent image on the drum 14 comes under the position of the trimming lamp 64.

The electrostatic charge latent image on the drum 14 is developed by the developing device 35. The record paper 47 is picked-up by the roller 49 from the cassette 12 and is fed to the transferring section 45 is synchronism with the rotation of the drum 14 under the control of the paper feed control circuit 158.

The toner image formed on the drum 14 is transferred at the section 45 onto the record paper and is then fixed on the paper by the fixing device 20. The final copy is discharged on the tray 13.

There are further provided first and second paper jam detecting circuits 200 and 202 which receive the paper detection signals from the first and second paper detectors 59 and 62, respectively as well as timing pulses from the selection circuit 172 which are coincident with timings at which the front edge of the paper comes at the positions of the first and second paper detectors 59 and 62, respectively. When one of the paper detectors 59 and 62 does not detect the paper when the related timing pulse is supplied to the related circuit 200 or 202, a paper jam signal is produced from the related circuit 200 or 202. This paper jam signal is supplied to the alarm circuit 154. Then the normal operation circuit 156 is made inoperative so as to disable the output gate 186. Therefore the main motor, corona charger 34, illuminating lamp 28, document feed rollers 26, heater 21, etc. are all made inoperative to stop the duplicating operation.

The alarm circuit 204 is composed of a timer which operates for a given time period (for instance 0.2 seconds). The output signal from the alarm circuit 204 energizes the solenoids 90 and 110 through an alarm driving circuit 206. Then the transfer roller 46 is made separated from the drum 14 and the reset mechanism is made operative. When the reset mechanism is driven, the alarm switch 120 is on and this condition is mechanically locked, so that the alarm detection circuit 154 is self-locked. Therefore the normal operation circuit 156 is remained inoperative and thus even if the main switch 7 is actuated, the copying operation could never be performed.

During the above mentioned locked condition the jammed paper is removed from the apparatus. During this removal operation the main switch 7 is made off.

After the jammed paper has been removed the reset button 117 is first depressed so as to release the reset mechanism and the alarm switch 120 is off. Then the main switch 7 is made on and the alarm detection circuit 154 is reset. At the same time the drum 14 begins to rotate, but the transfer roller 46 is still separated from the drum 14. Near the end of the first rotation of the drum 14 the return solenoid driving circuit 170 is made operative for a short time and the return solenoid 95 is energized. Then the transfer roller 46 is returned to the normal position and is urged against the drum 14 under a given pressure.

The trimming lamp control circuit 162 is so constructed that during the normal operation the trimming lamp 64 is lighted on when the rear edge of the latent image has passed the position of the lamp 64. The timing for lighting the lamp 64 on is different for the paper sizes to be used.

In the present embodiment if the document is set to actuate the first microswitch 25 before the power switch 7 is closed, the document is fed to the position of the second microswitch 27 and is held at this stand-by position until the copy start signal is generated. On the contrary if the document is in this stand-by position when the main switch 7 is made on, the document is discharged onto the tray 4 without being scanned.

Next an operation of the apparatus upon occurrence of abnormal conditions other than the paper jamming will be explained.

During the multiple duplication when all of papers in the cassette 12 are used, the record paper detection circuit 178 is made off. Then a counter provided in the copy number detecting circuit 182 is cleared so as to drive a copy stop circuit 208. At the same time the counter control circuit 164 is made inoperative to stop a new duplication. If a next document to be copied is set in the stand-by position at the second microswitch 27 when the nopaper in the cassette is detected, this document is discharged onto the tray 4. Further the longitudinal trimming lamp 64 is made lighted on by the control circuit 162 so as to erase the charge latent image on the drum 14.

According to the invention the jammed paper can be easily removed from the apparatus without damaging or injuring the transfer roller as well as the photosensitive drum. After the jammed paper has been removed the drum is rotated substantially one turn before a new duplicating operation is initiated and thus the residual toners and charge on the drum can be removed before the drum is again charged. Therefore the uniform charge can be obtained on the drum and a duplicated copy having excellent quality can be formed. Further in the above explained embodiment both ends of the transfer roller are supported independently and is uniformly urged against the drum under the predetermined pressure. Therefore the transfer pressure and transfer bias are made always uniform, so that a number of copies of good quality can be printed from the same and single electrostatic charge latent image.

Furthermore in the above embodiment the paper feed path has a length shorter than twice the length of the shortest paper and is formed substantially rectilinear and thus a possibility of paper jamming is rather small and the whole apparatus can be formed compact. Further the jammed paper can be easily removed along the paper feed path and at least one paper detector provided substantially at a middle of the paper path is enough to detect the paper jam.

The present invention is not limited to the embodiment explained above, but many modifications may be conceived within the scope of the invention. It is matter of course that the present invention may be applied to any type of electrophotographic apparatus other than the multiple copying type. The transfer roller may be replaced by a transfer endless belt or a transfer corona charger. The present invention can be applied not only to the plain paper copying (PPC) machine, but also to other type electrophotographic apparatuses such as TESI type apparatus and photosensitive screen type apparatus. In such apparatuses a back plate serving as the transferring member may be provided movably with respect to the charge retentive member. Upon the paper jamming the back plate is moved away from the charge retentive member and thus the jammed paper can be easily removed.

In the above embodiment after the jammed paper is removed the drum is rotated substantially one turn upon the actuation of the main switch. However the jammed paper may be taken off while the main switch is remained on. In this case the paper jam signal is once stored in a register and when the copying operation is started after the jammed paper has been removed, the stored paper jam signal is read out to drive the first rotation detecting signal. Moreover the returning operation of the transfer roller may be delayed upon the initiation of copying operation after the removal of the jammed paper. In this case the copy start signal may be produced by the insertion of a document into the apparatus or an actuation of a separate print start switch.

The paper detectors may be provided at any desired positions on the record paper feed path and the number of detectors is not limited to two.

In the above explained embodiment the duplicating operation is controlled by the timing pulses, but may be controlled in synchronism with the rotation of the drum. Moreover the reset mechanism may be driven by the separating solenoid instead of the alarm solenoid 110.

What is claimed is:

1. An electrophotographic apparatus comprising a retentive member arranged movably while retaining a visible toner image or an invisible electrostatic charge latent image corresponding to an image of a document to be copied;

a transferring member arranged movably at a transfer section with respect to the retentive member between a first operative position and a second inoperative position, in the first operative position the transferring member being closely adjacent to or in contact with the retentive member so as to be able to transfer the toner or charge image onto a record paper which is supplied between the retentive member and the transferring member along a record paper feed path, whilst in the second inoperative position the transferring member is separated from the retentive member, and means for detecting a paper jam on the record paper feed path to produce a paper jam signal; the improvements comprising means for moving the transferring member from the first operative position to the second inoperative position in response to the paper jam signal and for holding the transferring member in the second inoperative position; and means for releasing the holding condition of the transferring member in the second inoperative position and returning it into the first operative position after the jammed paper has been removed from the apparatus and the retentive member has moved at least by such an amount that a residual toner or charge image has passed through the transfer section.

2. An electrophotographic apparatus according to claim 1, further comprising means for removing the residual toner and/or charge image on the retentive member, whereby said releasing means is made operative after the residual toner and/or charge image on the retentive member have been at least once subjected to the removing operation of said removing means.

3. An electrophotographic apparatus according to claim 2, wherein said releasing means is made operative just when a portion of the retentive member which has been subjected to the operation of the removing means has arrived at the transferring section.

4. An electrophotographic apparatus according to claim 1, wherein said transferring member comprises a transfer roller.

5. An electrophotographic apparatus according to claim 1, wherein said transferring member comprises an endless belt.

6. An electrophotographic apparatus according to claim 1, wherein said transferring member comprises a corona charger for applying a charge on a rear surface of the record paper.

7. An electrophotographic apparatus according to claim 1, wherein said transferring member comprises a back plate arranged on a side of the record paper opposite to the retentive member and being connected to a given potential.

8. An electrophotographic apparatus comprising a photosensitive drum arranged rotatably at a given constant speed in a given direction;

a corona charger for uniformly charging the photosensitive drum;

an optical projection system for projecting an image of a document to be duplicated onto the uniformly charged drum so as to form an electrostatic charge latent image corresponding to the document image;

a developing device for developing the latent image with toners to form a visible toner image on the drum;

a transferring device including a transfer roller arranged movably substantially in a radial direction of the drum between a first operative position in which the transfer roller is made in contact with the drum under a given pressure so as to transfer the toner image on the drum onto a record paper and a second inoperative position in which the transfer roller is separated from the drum;

a cleaning device for removing residual toners on the drum;

an erasing lamp for erasing photoelectrically residual charge on the drum;

means for detecting a paper jam to produce a paper jam signal;

means for stopping the rotation of the drum in response to the paper jam; and means for initiating the rotation of the drum after the jammed paper has been removed from the apparatus; the improvements comprising means for moving the transfer roller from the first operative position to the second inoperative position in response to said paper jam signal;

mechanical locking means for holding mechanically the transfer roller in the second inoperative position;

means for releasing the mechanical locking means;

means for returning the transfer roller from the second inoperative position to the first operative position after the drum has rotated at least by such an angle that a rear end of residual toner and charge image on the drum has passed through the position of the transfer roller.

9. An electrophotographic apparatus according to claim 8, further comprising means for detecting at least a first rotation of the drum after a power supply to a driving mechanism for rotating the drum has been switched on, and producing a preparation end signal, whereby said returning means is made operative in response to the preparation end signal.

10. An electrophotographic apparatus according to claim 8, further comprising means for storing the paper jam signal and means for detecting at least a first rotation of the drum after a print start signal is generated after the jammed paper has been removed, and producing a preparation end signal when the paper jam signal is stored, whereby said returning means is made operative in response to the preparation end signal.

11. An electrophotographic apparatus according to claim 8, wherein the transfer roller is rotatably journaled at its both ends to swingable arms to which a spring is secured to urge the roller against the drum and said means for moving the roller from the first position to the second position comprises a solenoid having a plunger connected to at least one of the arms, whereby when the solenoid is energized, the arms are rotated against the spring force in such a first direction that the transfer roller is separated from the photosensitive drum.

12. An electrophotographic apparatus according to claim 11, wherein said mechanical locking means comprises a rotatably arranged hook lever having at one end thereof hook portion which engages with the arm when said solenoid is energized to rotate said arms in said first direction, and said releasing means comprises a second solenoid having a plunger connected to the other end of said hook lever, whereby when said solenoid is energized, said hook lever is rotated in such a direction that the hook portion is disengaged from the arm so as to rotate the arms in a second direction opposite to said first direction.

13. An electrophotographic apparatus according to claim 8, said means for initiating the rotation of the drum comprises a reset mechanism including a rotatably arranged first lever, a solenoid having a plunger connected to one end of the lever, a switch arranged to be actuated by the other end of the lever and for allowing a power supply to drum driving means in its closed state, a rotatably arranged second lever having at its one end a hook portion which engages with the other end of the first lever, a push button coupled to the other end of the second lever, a first spring coupled to the first lever to force the first lever to rotate in a first direction so as to close the switch and a second spring secured to said second lever to force the second lever to rotate in a first direction, whereby said solenoid is energized in response to the paper jam signal to rotate the first lever in a second direction opposite to said first direction against the first spring so as to open the switch and the first lever is retained in this position by engaging the hook portion of the second lever with the other end of the first lever, and when said push button is depressed after the jammed paper has been removed, the second lever is rotated against the second spring in a second direction opposite to the first direction so as to disengage the hook portion from the first lever and to rotate the first lever in the first direction to close the switch.

14. An electrophotographic apparatus according to claim 8, wherein any desired number of copies are formed from the same and single electrostatic charge latent image by repeatedly effecting the developing and transferring operations, while the cleaning device, erasing lamp, corona charger and optical projection system are made inoperative.

15. An electrophotographic apparatus according to claim 8, further comprising a counter for counting clock pulses which are generated in synchronism with the rotation of the drum to produce a preparation end signal when the drum has rotated over an angle from the cleaning device to the transfer roller measured in the rotational direction of the drum after the jammed paper has been removed, whereby said returning means is made operative in response to the preparation end signal.

16. An electrophotographic apparatus according to claim 8, further comprising a trimming lamp provided between the optical projection system and the developing device for erasing the charge on the drum and a counter for counting clock pulses which are generated in synchronism with the rotation of the drum to produce a preparation end signal when the drum has rotated over an angle from the trimming lamp to the transfer roller after the jammed paper has been removed, whereby the returning means is made operative in response to the preparation end signal.

* * * * *